US005944412A

United States Patent [19]

Janos et al.

[11] Patent Number: 5,944,412

[45] Date of Patent: Aug. 31, 1999

[54] ELECTRIC LIGHTING FIXTURE LOCK

[75] Inventors: George L. Janos, Bartlett; John Petrakis, Cary, both of Ill.

[73] Assignee: Juno Lighting, Inc., Des Plaines, Ill.

[21] Appl. No.: 08/840,920

[22] Filed: Apr. 25, 1997

[51] Int. Cl.[6] ..... F21S 1/06

[52] U.S. Cl. ..... 362/365; 362/148; 362/368

[58] Field of Search ..... 362/147, 148, 362/364, 365, 366, 368

[56] References Cited

U.S. PATENT DOCUMENTS

| | | | |
|---|---|---|---|
| 4,733,339 | 3/1988 | Kelsall | 362/366 |
| 4,739,460 | 4/1988 | Kelsall | 362/365 |
| 5,314,148 | 5/1994 | Jones | 362/365 |
| 5,609,408 | 3/1997 | Targetti | 362/66 |
| 5,609,414 | 3/1997 | Caluori | 362/366 |

*Primary Examiner*—Alan Cariaso
*Attorney, Agent, or Firm*—Anthony S. Zummer

[57] ABSTRACT

An improved lock used with a recessed lighting fixture is the present subject matter. The fixture is adapted for installation in a mounting aperture in a ceiling. The fixture includes a frame which has a retainer ring for connection to the outside or bottom of the ceiling. A lock is pivotly mounted in the frame and is also movably mounted in the frame. The lock is engageable with the interior or upper surface of the ceiling to hold the frame in the mounting aperture. The lock includes a latch which releasably engages the frame to hold the lock in one position relative to the frame and thereby hold the frame in the mounting aperture. The lock includes a shipping notch engageable with the frame to retain the lock in the frame during shipment of the frame to a site for installation in a ceiling.

8 Claims, 5 Drawing Sheets

ELECTRIC LIGHTING FIXTURE LOCK

BACKGROUND OF THE INVENTION

Recessed electric lighting fixtures typically are installed during the construction or remodeling of a building. In some instances, it is found to be desirable to install recessed lighting in an existing structure. It is necessary to support a recessed lighting fixture on an interior structural surface, such as, a ceiling in some installations. An aperture or mounting opening is cut in the ceiling in certain installations. The aperture is of a size just large enough to receive the electric lighting fixture. A frame for the electric lighting fixture is positioned in the aperture. Locks are connected to the frame and those locks are moved into position to engage the interior of the ceiling to prevent the lighting fixture from falling out through the aperture.

The locks that have been heretofore used in such installations are of a variety of types. One type of such a lock is a lock made of a spring steel. The spring steel lock is inserted through an opening in the frame, and a resilient arm of the lock engages the upper side of the ceiling to hold the frame in the ceiling aperture. One of the problems which has been encountered with such locks is that vibration of the structure often causes the locks to release and allow the fixture to fall out of the ceiling. One solution to overcome the problem of vibration of the structure is to drive a screw through the spring lock after it is placed into engagement with the interior of the ceiling to secure the lock to the frame. Another problem encountered with such locks is that when the locks are shipped from the manufacturer to the site, locks often become loose enough to disengage the frame and become lost during transit or unpacking of the fixture. It is desirable to provide a lock for a recessed lighting fixture which lock is held securely in the frame during shipment and the lock securely holds the frame in position in a ceiling aperture.

SUMMARY OF THE INVENTION

An improved lock is used with a recessed electric lighting fixture, which fixture is adapted for installation in a mounting aperture in an interior structural surface, such as, a ceiling. The fixture includes a frame. The frame has a retainer ring for connection to the outside or bottom of the ceiling. The frame has a holding aperture and a locking aperture spaced from the holding aperture. The lock is pivotly mounted in the holding aperture and movably mounted in the locking aperture. The lock is engageable with the interior or upper surface of the ceiling to hold the frame in the mounting aperture. A latch which is part of the lock releasably engages the frame to hold the lock in one position relative to the frame and thereby hold the frame in the mounting aperture. The lock includes a shipping notch engageable with the frame to retain the lock in the frame during shipment of the frame to a site for installation in a ceiling.

DESCRIPTION OF THE PREFERRED EMBODIMENT

Figure 1:
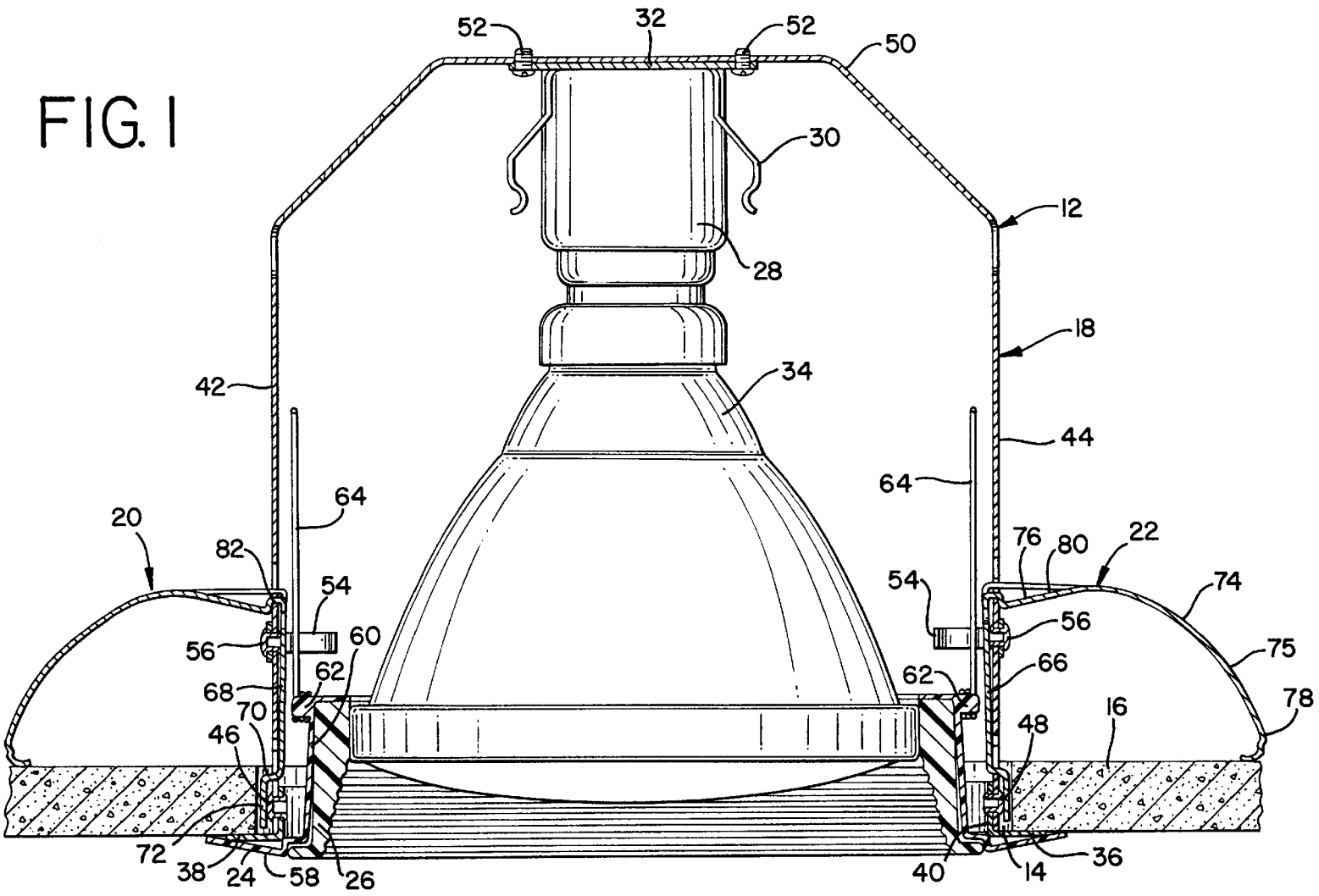
FIG. 1 is a cross sectional view through a conventional ceiling showing a recessed lighting fixture having a frame mounted in an aperture in the ceiling with two locks embodying the instant invention holding the frame in the aperture.

Referring now to the drawings and especially to FIG. 1, a recessed electric lighting fixture 12 is shown mounted in a mounting aperture 14 of a conventional interior structural surface, namely a ceiling 16. The fixture generally includes a frame 18 locked into aperture 14 by a pair of identical locks 20 and 22, each of which is a specific embodiment of the herein disclosed invention. A trim ring assembly 24 is mounted in the frame and supports a conventional annular baffle 26. A conventional lamp receptacle 28 is held in position by a receptacle clip 30. The receptacle clip is secured to a receptacle mounting plate 32 which is in turn secured to frame 18. A conventional lamp 34 is mounted in receptacle 28 and positioned within baffle 26.

Frame 18 of the recessed electric lighting fixture 12 is disclosed in detail in a co-pending patent application entitled, "Open Mounting Frame", the inventor is Thomas J. DeCicco, is Ser. No. 08/936,222, and filing date of Sept. 29, 1997. The frame includes an annular base ring retainer 36. Retainer 36 includes an annulus 38 and an annular short crown 40 formed integral with the annulus. Two flat columnar uprights 42 and 44 are connected to crown 40 and are diametrically opposed to each other. Uprights 42 and 44 are connected to the crown by conventional rivets 46 and 48, respectively. A bridge 50 is formed integral with the ends of uprights 42 and 44 to connect the uprights. Receptacle plate 32 is fixed to bridge 50 by conventional screws 52.

A conventional torsion spring receptacle 54 is connected to each of the uprights 42 and 44 by conventional rivets 56. The trim ring includes a trim ring face 58 with a cylindrical baffle housing 60 formed integral therewith. The baffle housing has a pair of diametrically opposed spring studs 62 formed thereon. A conventional torsion spring 64 is mounted on each of spring studs 62. The construction of each torsion spring is conventional and well known and includes a pair of arms positionable in the respective receptacle 54 to hold the trim ring and baffle in position.

The construction of locks 20 and 22 is identical and like numbers are used for the same parts. Each of the locks is formed from a single piece of conventional flat spring steel so that the parts of the lock are resilient. Each lock includes a post 66. Each post includes a pillar 68 with an off-set 70 formed integral with the lower end thereof. A leg 72 is formed integral with off-set 70. An arcuate resilient retainer 74 is formed integral with the upper end of the post. Each arcuate retainer includes a curved elongated resilient body 75. A latch 76 is integral with and adjacent to one end of each body and a head 78 is integral with the other end. Each latch 76 includes a cantilever latch arm 80 formed integral with the body of the respective arcuate retainer. A latch hook 82 is formed integral with the free end of each latch arm. Each latch hook is positioned in a T-shaped latch head opening 84 in the pillar.

Figure 9:
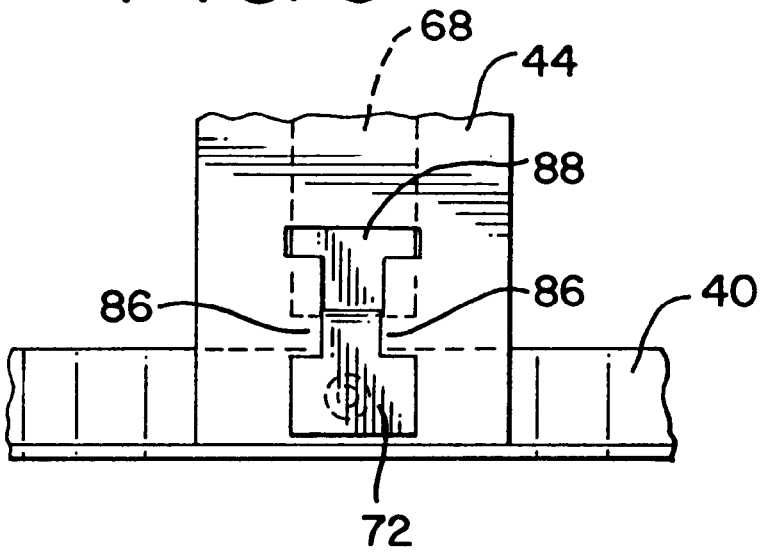
FIG. 9 is an enlarged fragmentary elevational view taken on Line 9—9 of FIG. 2.
Figure 10:
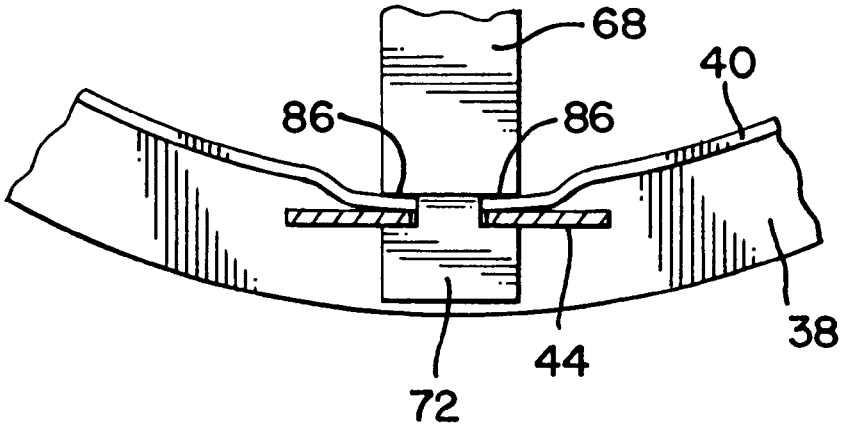
FIG. 10 is an enlarged partial cross sectional view taken on Line 10—10 of FIG. 4.

Off-set 48 has a pair of opposed identical notches 86, which extend into the upper portion of respective leg 72, as may be seen in FIG. 9. Each of the columnar uprights 42 and 44 has a T-shaped holding aperture 88, which receives post 66 and retains the respective lock in position. Each of the columnar uprights 42 and 46 has a T-shaped locking aperture 90 positioned above the respective holding aperture 88. Each locking aperture 90 receives its respective arcuate retainer 74.

Head 78 of each of the locks includes an ear 92 adapted for engagement with the upper or interior surface of ceiling. The head includes a shipping notch 94 with a ridge 96 between the notch and the ear.

Each of the locks is installed in frame 18 with the respective leg in respective slot 88. Each head 78 is positioned in the respective locking aperture 90. Notch 94 receives the edge of the respective columnar upright. Ridge 96 cooperates with the notch to prevent the head from sliding out of the aperture. Inasmuch as the lock is made of unitary spring steel, the arcuate retainer is resilient and holds the head in place through the coaction of the shipping notch and the upright, so that frame 18 may be shipped with locks 20 and 22 in position, as shown in FIG. 4, without the locks becoming separated from the frame.

Figure 2:
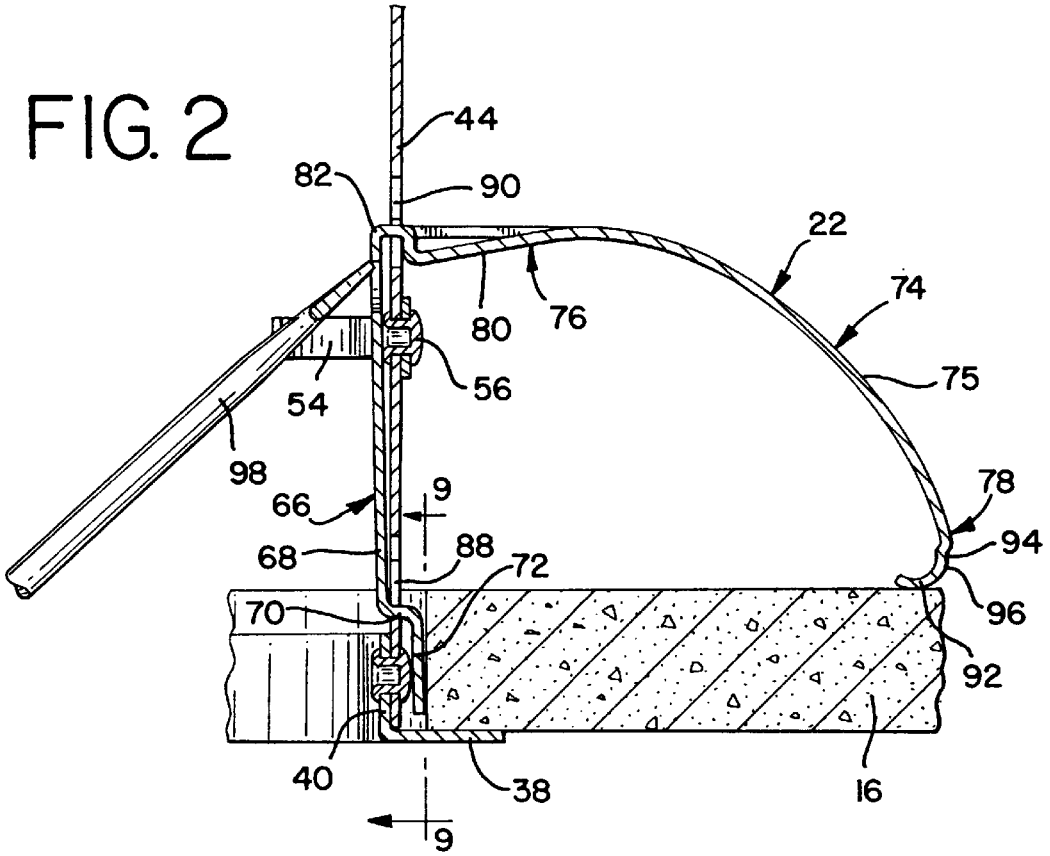
FIG. 2 is an enlarged cross sectional view of one of the locks of FIG. 1 showing the position of a screwdriver blade in engagement with a latch used for releasing the lock from the frame to allow removal of the frame from the opening.
Figure 4:
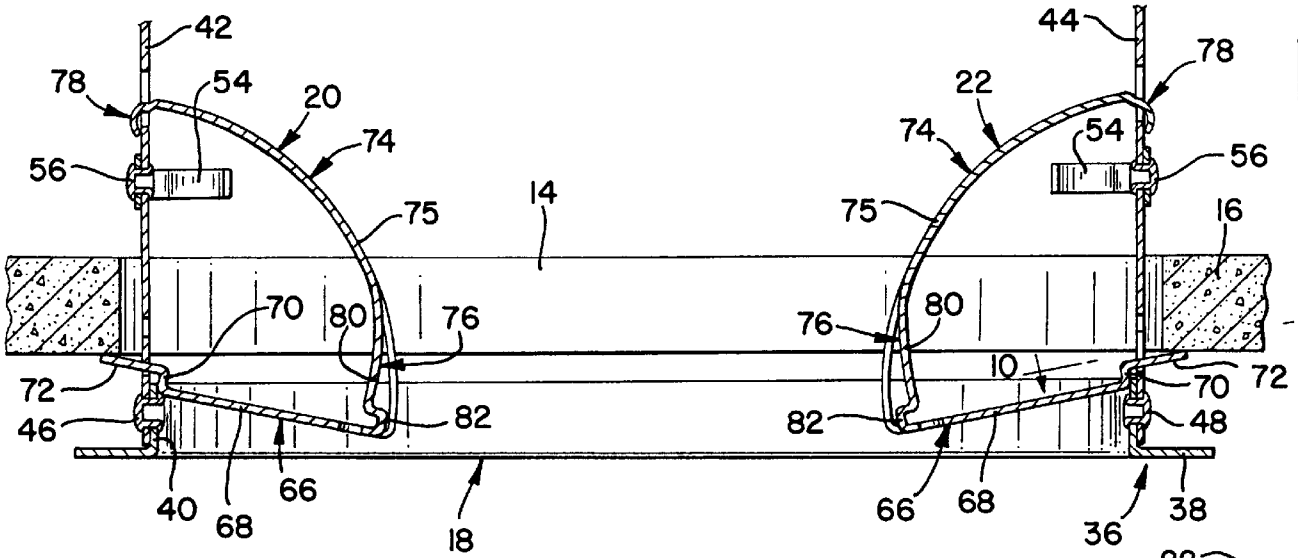
FIG. 4 is an enlarged cross sectional view showing two locks in a retracted position in the frame and the frame partially positioned in the ceiling aperture.
Figure 7:
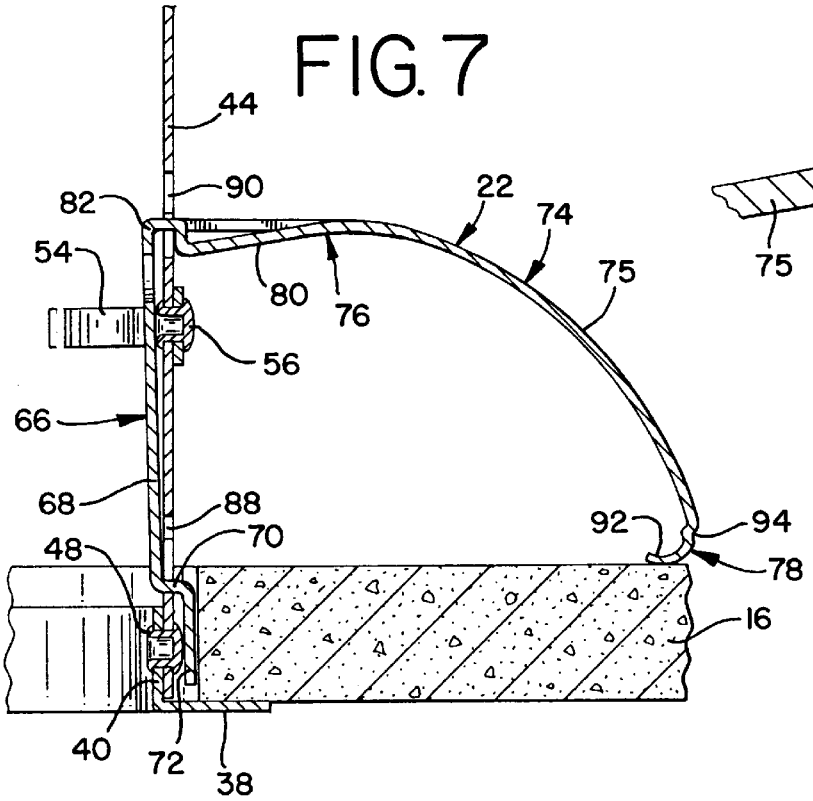
FIG. 7 is an enlarged cross sectional view similar to FIG. 2 showing a latch in engagement with the frame to hold the lock in position relative to the frame.
Figure 8:
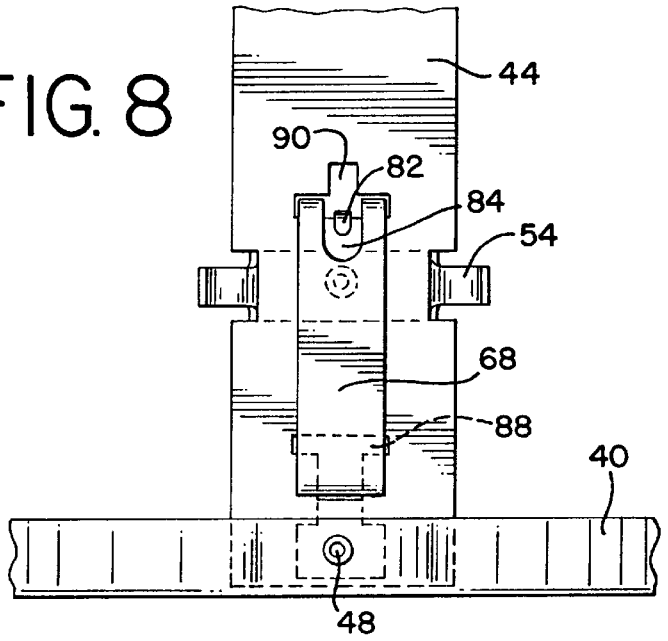
FIG. 8 is an end elevational view of the lock shown in FIG. 7.

With the locks in a retracted or shipping position, as shown in FIG. 4, the frame is placed in aperture 14 of the ceiling. The frame is moved upward into the aperture so that legs 72 engage the lower surface of ceiling 16. Continued movement of the frame into the ceiling aperture forces the legs to pivot toward the crown. As the legs approach the annular crown, the heads disengage the upright and the arcuate retainers move outward for the heads to pivot into engagement with the upper surface of the ceiling, as shown in FIGS. 1, 2 and 7. As the respective heads 78 of the arcuate retainers engage the ceiling, latch arms 80 slide through the respective locking apertures 90 until latch hooks 82 move into place receiving the respective columnar uprights. Thus, the latches secure the locks in position to hold the frame in the ceiling aperture. The annular base ring engages the lower surface of the ceiling while the heads of locks 20 and 22 resiliently engage the upper surface of the ceiling to hold the frame in place.

Once the frame is in place, lamp 34 is put into position and the baffle and trim ring are locked into position by inserting torsion springs 64 into their respective receptacles 54 to hold the trim ring up against the ceiling.

Figure 3:
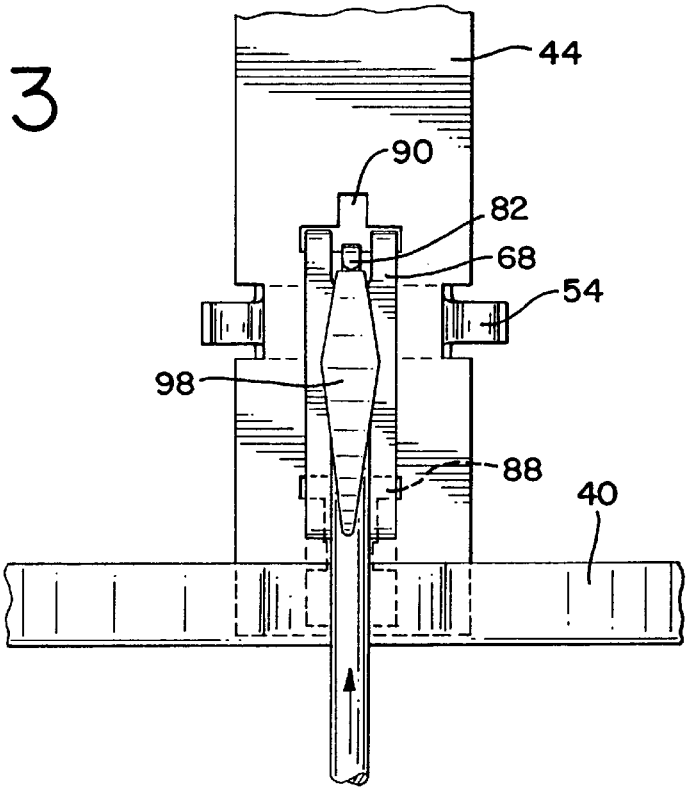
FIG. 3 is a side elevational view showing the screwdriver blade of FIG. 2 contacting the latch for release of the lock.
Figure 5:
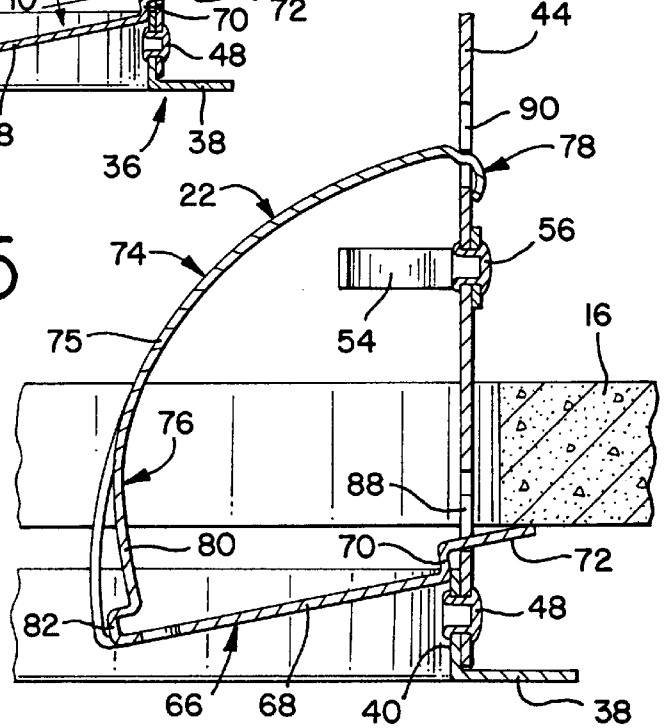
FIG. 5 is an enlarged cross sectional view of one of the locks of FIG. 4.
Figure 6:
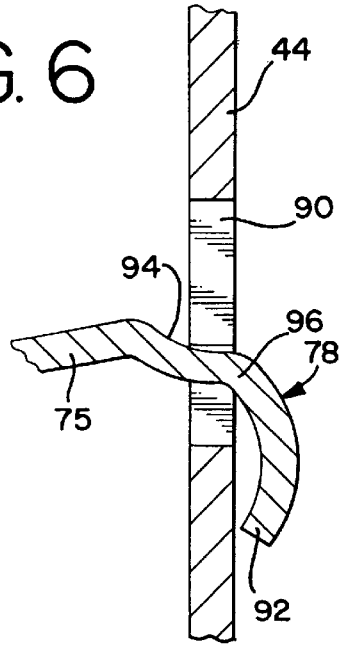
FIG. 6 is an enlarged fragmentary cross sectional view of a head portion of one of the locks of FIG. 4 showing a shipping notch in the lock in engagement with the frame.

In the event that it is necessary to remove the frame from aperture 14, the frame may be readily removed by first removing the trim ring and baffle and then removing lamp 34. As shown in FIGS. 2 and 3, a conventional screwdriver blade 98 is inserted through the opening in the annulus to engage the latch head. The screwdriver is used to raise the latch to disengage the respective columnar upright. Downward movement of the frame causes the arcuate retainer to flatten until the legs 72 are out of the aperture. Further downward movement of the frame forces the arcuate retainer to slide through the locking aperture 90 and pivot legs 72 outward. Once the legs pass the ceiling, the locks assume the unlocked position shown in FIGS. 4 and 5. The frame then may be quickly and easily withdrawn from the ceiling aperture.

Although a specific embodiment of the herein disclosed invention has been shown and described in detail above, it is readily apparent that those skilled in the art may make various modifications and revisions to the subject invention without departing from the spirit and scope thereof. It is to be expressly understood that the instant invention is limited only by the appended claims.

What is claimed is:

1. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes an arcuate retainer movably mounted in the locking aperture, said latch being formed integral with the arcuate retainer for holding the arcuate retainer in a selected position when the latch engages the frame.

2. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes a post, said post having a leg being engagable with the structural surface to pivot the lock into an attitude wherein the post is substantially parallel to and adjacent to a portion of the frame and the latch engages the frame.

3. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes an arcuate retainer movably mounted in the lock aperture, said latch being formed integral with the arcuate retainer for holding the arcuate retainer in a selected position with the latch in engagement with the frame, a shipping notch formed integral with the arcuate retainer, said shipping notch releasably engagable with the frame in the locking aperture for releasably holding the lock in a retracted attitude to allow insertion of the frame into the mounting aperture.

4. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes a shipping notch releasably engagable with the frame in the locking aperture for holding the lock in a retracted attitude to allow insertion of the frame into the mounting aperture, said lock including a post, said post having a leg engagable with the structural surface to pivot the lock into an attitude wherein the post is substantially parallel to and adjacent to a portion of the frame and the latch engages the frame.

5. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes a post, said post having a pillar, said pillar having a latch head opening movably receiving a portion of the latch, an elongated arcuate retainer having one end formed integral with the pillar, said arcuate retainer movably mounted in the locking aperture, said latch being formed integral with the arcuate retainer adapted for holding the arcuate retainer in a selected position when the latch engages the frame.

6. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, the lock is formed from a single resilient flat member, said lock includes a post, said post having a pillar, said pillar having a latch head opening movably receiving a portion of the latch, an elongated arcuate retainer having one end formed integral with the pillar, said arcuate retainer movably mounted in the locking aperture, a head formed integral with an end of the arcuate retainer opposite the end formed integral with the pillar, said latch being formed integral with the arcuate retainer for holding the arcuate retainer in a selected position wherein the head engages the interior structural surface and the latch engages the frame.

7. In a recessed electric lighting fixture adapted for installation in a mounting aperture in an interior structural surface including, a lighting fixture frame, said frame including a retainer adapted for connection to a side of the interior structural surface, said frame having a holding aperture, a locking aperture in said frame spaced from the holding aperture, the improvement being a resilient unitary lock mounted in the holding aperture and movably mounted in the locking aperture, said lock being connectable to a side of the structural surface opposite to the first-mentioned side to hold the frame in the mounting aperture, said lock having a latch releasably engaging the frame to hold the lock in one position in connection to said side opposite to the first-mentioned side for holding the frame in the mounting aperture, said lock includes a post, said post having a pillar, said pillar having a latch head opening removably receiving a portion of the latch, an offset formed integral with one end of the pillar, said offset movably mounted in the holding aperture, a leg formed integral with the offset and being engagable with the structural surface, an arcuate retainer formed integral with the end of the pillar opposite the end formed integral with the offset, a head formed integral with the arcuate retainer opposite the end formed integral with the pillar, said head being engagable with the interior structural surface, said latch being formed integral with the arcuate retainer for holding the arcuate retainer in a position when the head is in engagement with the interior structural surface and the latch engages the frame.

8. In a recessed electric lighting fixture adapted for installation in a mounting aperture in an interior structural surface including, a lighting fixture frame, said frame including a retainer adapted for connection to a side of the interior structural surface to restrict movement of the frame relative to the structural surface in one direction, said frame having a holding aperture, a locking aperture in said frame spaced from the holding aperture, the improvement comprising a lock mounted in the holding aperture and releasably lockable to the frame in the locking aperture, said lock being formed from a single resilient flat member, said lock including a post having a pillar, said pillar having a latch head opening, an offset formed integral with one end of the pillar, said offset movably mounted in the holding aperture, a leg formed integral with the offset and being engagable with the structural surface, and an arcuate retainer formed integral with the pillar, said arcuate retainer having a curved longitudinal resilient body having one end formed integral with an end of the pillar opposite the offset, a head formed integral with an end of the longitudinal body opposite the end formed integral with the pillar, said head being engagable with a second side of the interior structural surface opposite to the first-mentioned side to hold the frame in the mounting aperture in interior structural surface, a shipping notch formed integral with and positioned adjacent to the head, said shipping notch positionable in and resiliently engagable with the locking aperture of the frame, a latch formed integral with the longitudinal body, said latch having a cantilever resilient latch arm having one end formed integral with the longitudinal body, and a latch hook formed integral with the free end of the latch arm and being receptive of a portion of the frame in the locking aperture to hold the head against the interior structural surface, whereby pivoting of the pillar causes the arcuate retainer to extend outward from the frame for engagement of the head with the interior surface and the latch hook resiliently engages the frame at the locking aperture to lock the arcuate retainer into position.

* * * * *